US007347267B2

(12) United States Patent
Morys et al.

(10) Patent No.: US 7,347,267 B2
(45) Date of Patent: Mar. 25, 2008

(54) METHOD AND APPARATUS FOR COOLING FLASKED INSTRUMENT ASSEMBLIES

(75) Inventors: Marian L. Morys, Downingtown, PA (US); Scott P. Murta, Exton, PA (US); Robert E. Epstein, Downingtown, PA (US)

(73) Assignee: Halliburton Energy Services, Inc., Houston, TX (US)

( * ) Notice: Subject to any disclaimer, the term of this patent is extended or adjusted under 35 U.S.C. 154(b) by 335 days.

(21) Appl. No.: 10/993,159

(22) Filed: Nov. 19, 2004

(65) Prior Publication Data

US 2006/0108116 A1 May 25, 2006

(51) Int. Cl.
*E21B 36/00* (2006.01)

(52) U.S. Cl. ..... 166/302; 166/57; 166/65.1; 62/260

(58) Field of Classification Search ..... 166/302, 166/57, 65.1, 66; 165/45; 62/259.2, 260, 62/451, 903
See application file for complete search history.

(56) References Cited

U.S. PATENT DOCUMENTS 2,433,554 A * 12/1947 Herzog ..... 250/261
2,711,084 A * 6/1955 Bergan ..... 62/259.2
2,824,233 A * 2/1958 Herzog ..... 250/261
2,893,213 A * 7/1959 Soloway ..... 62/4
3,167,653 A * 1/1965 Hoyer et al. ..... 250/261
3,170,519 A * 2/1965 Haagensen ..... 166/60
3,382,923 A 5/1968 Parker et al.
3,488,970 A * 1/1970 Hallenburg ..... 62/3.2
4,291,364 A 9/1981 Andros et al.
4,407,136 A 10/1983 Kanter
4,440,219 A 4/1984 Engelder
4,498,118 A 2/1985 Bell
5,265,677 A 11/1993 Schultz
5,275,038 A * 1/1994 Sizer et al. ..... 73/152.02
5,419,188 A * 5/1995 Rademaker et al. ..... 73/152.54
5,829,519 A 11/1998 Uthe
6,427,466 B1 8/2002 Livni
6,769,487 B2 * 8/2004 Hache ..... 166/302
2004/0112601 A1 6/2004 Hache

* cited by examiner

*Primary Examiner*—Kenneth Thompson
(74) *Attorney, Agent, or Firm*—Conley Rose, P.C.

(57) ABSTRACT

Method and apparatus are provided to accelerate the cooling of thermally sensitive components in a chamber of a downhole instrument assembly. In accordance with the invention, a passage is formed in the chamber and a fluid is conveyed through the passage to cool the components to the desired temperature. By using the method and apparatus of the present invention the amount of time to cool the components is dramatically less than the time required for cooling using conventional techniques.

35 Claims, 3 Drawing Sheets

METHOD AND APPARATUS FOR COOLING FLASKED INSTRUMENT ASSEMBLIES

BACKGROUND OF THE INVENTION

1. Field of the Invention

The present invention relates to flasked instrument assemblies that are used in downhole tools, and, in particular, to the cooling of the electronic chassis in such an assembly.

2. Description of the Prior Art

It is well-known that downhole instrument assemblies are used in extremely hostile environments. Downhole tools such as logging tools, logging while drilling tools, measurement while drilling tools, and guidance tools that are used in the drilling of deviated wells employ such assemblies. Downhole instrument assemblies typically comprise thermally sensitive components which have a maximum temperature above which they will not operate properly. Such components may, for example, be electronic, optical or mechanical devices which are used to measure various parameters of the well or the formation or the fluid in the well or the fluid in the formation. In order to protect the components in these downhole instrument assemblies, the components are encased in a thermal flask.

When these downhole instrument assemblies contain electronic components, such components are mounted on an electronics chassis in the thermal flask. One function that the thermal flask provides is to isolate the electronic components from the heat of the environment in the wellbore. Such thermal flasks also contain the heat which is generated by the operation of the electronic components in the electronics chassis. The electronics chassis is designed to provide a large thermal mass, which enables the instrument assembly to operate downhole for an extended period of time before the temperature within the thermal flask become such that the operation of the electronic components are degraded. When the electronics chassis reaches a certain critical temperature, downhole operations must be stopped and the instrument assembly must be hoisted back to the surface in order to prevent damage to the assembly. Downhole operations may only be resumed once the electronics chassis has sufficiently cooled down.

The properties of the thermal flask which protect the electronics chassis from environmental heat also retard the release of the heat generated by the electronic components within the flask. Accordingly, research studies by the Assignee of this application have shown that cooling a logging tool by radiation and convection alone (i.e., passive cooling) will require a substantial amount of time, e.g., sixty plus hours, before logging operations may be resumed. Further, it is not feasible to extract the hot electronic components from the thermal flask in an effort to expedite cooling, because such extraction subjects the electronic components to thermal shock and exposure to atmospheric moisture.

SUMMARY OF THE INVENTION

The present invention is directed to apparatus for use in a downhole assembly comprising a chamber containing thermally sensitive instrumentation and at least one passage through the chamber through which cooling fluid may flow. The thermally sensitive instrumentation may comprise electronic, optical or mechanical components. In one specific embodiment, apparatus in accordance with the present invention comprises a thermal flask in which an electronic chassis resides that contains electronic components that are used in a downhole instrument assembly. A thermal flask according to the present invention includes a passage through the flask proximate the electronic chassis. The passage has an inlet and an outlet, and the inlet is adapted to be coupled to a source of fluid. As the fluid in the fluid source flows in the passage, active cooling of the electronics chassis in the thermal flask assembly is provided. The passage is hermetically sealed from the volume containing the electronic components to prevent moisture damage to the electronic components.

In one embodiment of the invention, the inlet and outlet of the passage are located on the same side of the thermal flask, while in yet another embodiment the inlet and outlet of the passage are located on opposite ends of the thermal flask. In another embodiment of the present invention, multiple tools may be cooled simultaneously through serial or parallel connections.

In accordance with the present invention, apparatus is provided for cooling a downhole assembly comprising a hermetically sealed chamber containing components for measuring downhole parameters. The downhole assembly further comprises a passage through the hermetically sealed chamber in which a fluid may flow to cool the components in the chamber. The passage has an inlet and an outlet and is hermetically sealed from the components in the chamber.

In a particular embodiment of the invention, apparatus is provided for cooling an electronic chassis of a downhole instrument assembly. The apparatus comprises a thermal flask with a passage through it as described above. Such apparatus further comprises a pressure housing in which the thermal flask resides. Apparatus in accordance with the present invention also comprises a source of fluid, and an inlet coupling operatively connecting the inlet of the passage to the source of the fluid to permit fluid from the fluid source to flow in the passage. An outlet coupling is operatively connected to the outlet of the passage to permit fluid in the passage to exit the thermal flask.

In accordance with the present invention, the electronics chassis of a downhole instrument assembly may be cooled once the downhole instrument assembly has been retrieved from the downhole environment. Alternatively, the electronics chassis of the downhole instrument assembly may be cooled below ambient temperature before the downhole instrument assembly is conveyed downhole. In this embodiment, apparatus in accordance with the present invention comprises a heat exchanger which is interposed between the source of fluid and the inlet coupling and which is used to cool the electronics chassis to a temperature below ambient temperature, e.g. −30° C.

In accordance with the present invention, a method of cooling thermally sensitive instrumentation in a chamber of a downhole instrument assembly is provided. The method comprises forming a passage in the chamber having an inlet and outlet and conveying a fluid through the passage to cool the instrumentation in the chamber. In one particular embodiment, the method of the present invention enhances the transfer of heat out of an electronic chassis in a thermal flask in a downhole instrument assembly. The method comprises forming a passage in the thermal flask which has an inlet and an outlet and which is proximate to and hermetically sealed from the electronic chassis. The method further comprises operatively connecting a source of fluid to the inlet of the passage, and then passing the fluid through the passage to enhance the transfer of heat out of the electronics chassis of the thermal flask. In an alternative embodiment, a method in accordance with the present comprises the further step of cooling the fluid from the fluid source to a temperature below ambient temperature before the fluid is permitted to flow through the passage.

DESCRIPTION OF SPECIFIC EMBODIMENTS

It will be appreciated that the present invention may take many forms and embodiments. Some embodiments of the present invention are described so as to give an understanding of the invention. Thus, the embodiments of the invention that are described herein are intended to be illustrative and not limiting of the invention.

As used in this specification and in the appended claims, two items are "operatively connected" when those items are directly connected to one another or connected to one another via another element. Additionally, the term "downhole instrument assembly" is used to refer to any instrument which is used in a downhole environment and which contains components which only operate satisfactorily up to a specified temperature limit. A "downhole instrument assembly" may, for example, comprise an electronic chassis which is encased in a thermal flask, and examples of such assembles are found in logging tools, logging while drilling tools, measurement while drilling tools and guidance assemblies that are used in the drilling of deviated wells.

Figure 1:
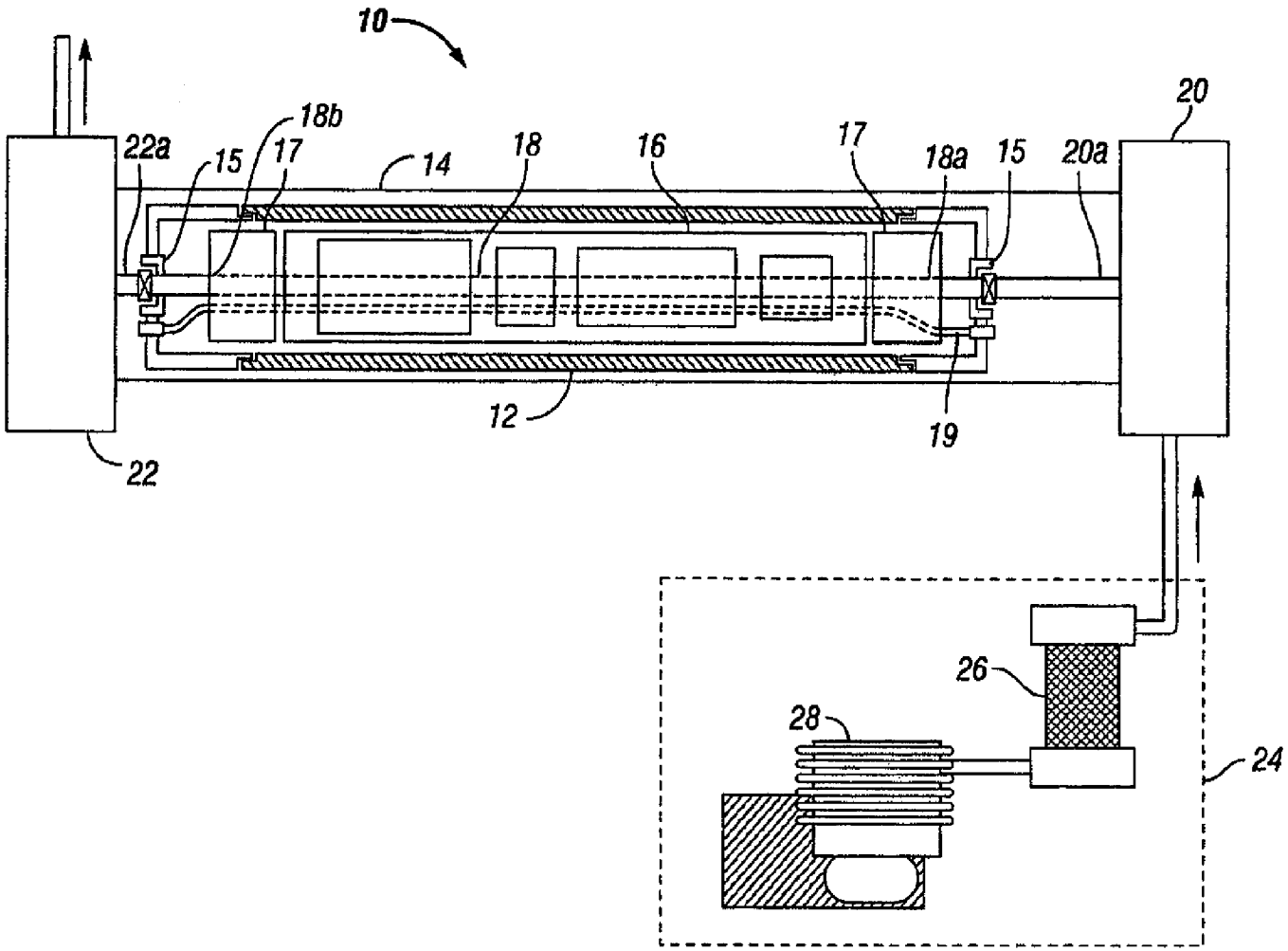
FIG. 1 is a simplified schematic drawing of one embodiment of the apparatus in accordance with the present invention.

Referring to FIG. 1, downhole instrument assembly 10 is illustrated. Assembly 10 comprises a thermal flask 12, which in the embodiment of FIG. 1 resides in a pressure housing 14. In an alternative embodiment, the thermal flask 12 and the pressure housing 14 may be an integral structure. The thermal flask 12 comprises an electronics chassis 16 which is hermetically sealed in thermal flask 12.

Figure 2:
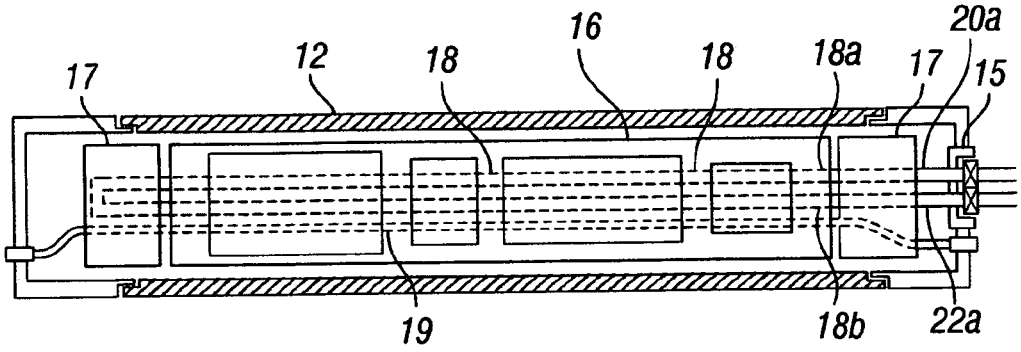
FIG. 2 is a simplified schematic of the thermal flask of FIG. 1 which illustrates an alternative configuration for the passage 18 in FIG. 1.

In accordance with the present invention, a passage 18 is formed in the thermal flask 12 which is proximate to the electronics package 16 and which is hermetically sealed from electronics package 16. Passage 18 has an inlet 18*a* and outlet 18*b*, and in one embodiment, has a diameter of approximately 0.25 inches. In FIG. 1, the inlet 18*a* and the outlet 18*b* of passage 18 are on opposite ends of thermal flask 12. In an alternative embodiment, however, the inlet 18*a* and the outlet 18*b* of passage 18 may be on the same end of thermal flask 12, as illustrated in FIG. 2.

The thermal flask 12 of FIG. 1 also comprises thermal isolation material 17 which is disposed inside the thermal flask 12 at each end of the electronics chassis 16 as shown to diminish the transfer of environmental heat into the thermal flask 12 when the tool is in operation. Thermal isolation material 17 may, for example, be PEEK brand thermal material. The thermal flask 12 also comprise removable seals 15, which are installed when the tool is being used downhole. Further, the thermal flask 12 may comprise wires 19 which are use to connect circuitry in the thermal flask to appropriate monitoring/recording equipment (not shown) at the earth's surface.

Still referring to FIG. 1, apparatus in accordance to the present invention includes inlet coupling 20 and outlet coupling 22. In order to cool the electronics chassis 16, seals 15 are removed, and tubular portion 20*a* of inlet coupling 20 is operatively connected to the inlet 18*a* of passage 18. Inlet coupling 20 is also operatively connected to a fluid source 24, and when so connected, the fluid in fluid source 24 flows into the passage 18 to cool the electronics chassis in thermal flask 12. Outlet coupling 22 includes tubular portion 22*b* which is operatively connected to the outlet 18*b* of passage 18 to permit fluid flowing in the passage to exit the thermal flask 12.

The fluid in fluid source 24 may be any substance which deforms continuously under the application of a sheer stress and which is suitable for use in cooling applications. Compressed air, carbon dioxide or nitrogen gas are examples of suitable fluids that may be contained in fluid source 24. If the fluid in fluid source 24 is compressed air, air pump 28 is used to generate the compressed air and the output of air pump 28 is filtered by air filter 26.

Apparatus in accordance with present invention may be utilized to cool the electronics chassis 16 in thermal flask 12 not only after the instrument assembly has been used downhole, but also may be utilized to cool the electronics chassis to a temperature below ambient temperature before the instrument assembly is run downhole. Typically, electronic components are capable of operating reliably at temperatures as low as −30° C. By cooling the electronics package prior to conveying the instrument assembly downhole, the length of time that the electronics chassis can operate downhole before it has to be retrieved is increased. For example, if the electronics chassis is cooled to −30° C. before the instrument assembly is conveyed downhole, that electronics chassis has a 60° C. advantage over a chassis which is conveyed downhole at a typical ambient temperature of 30° C. That advantage translates to several more hours of downhole operating time.

Figure 3:
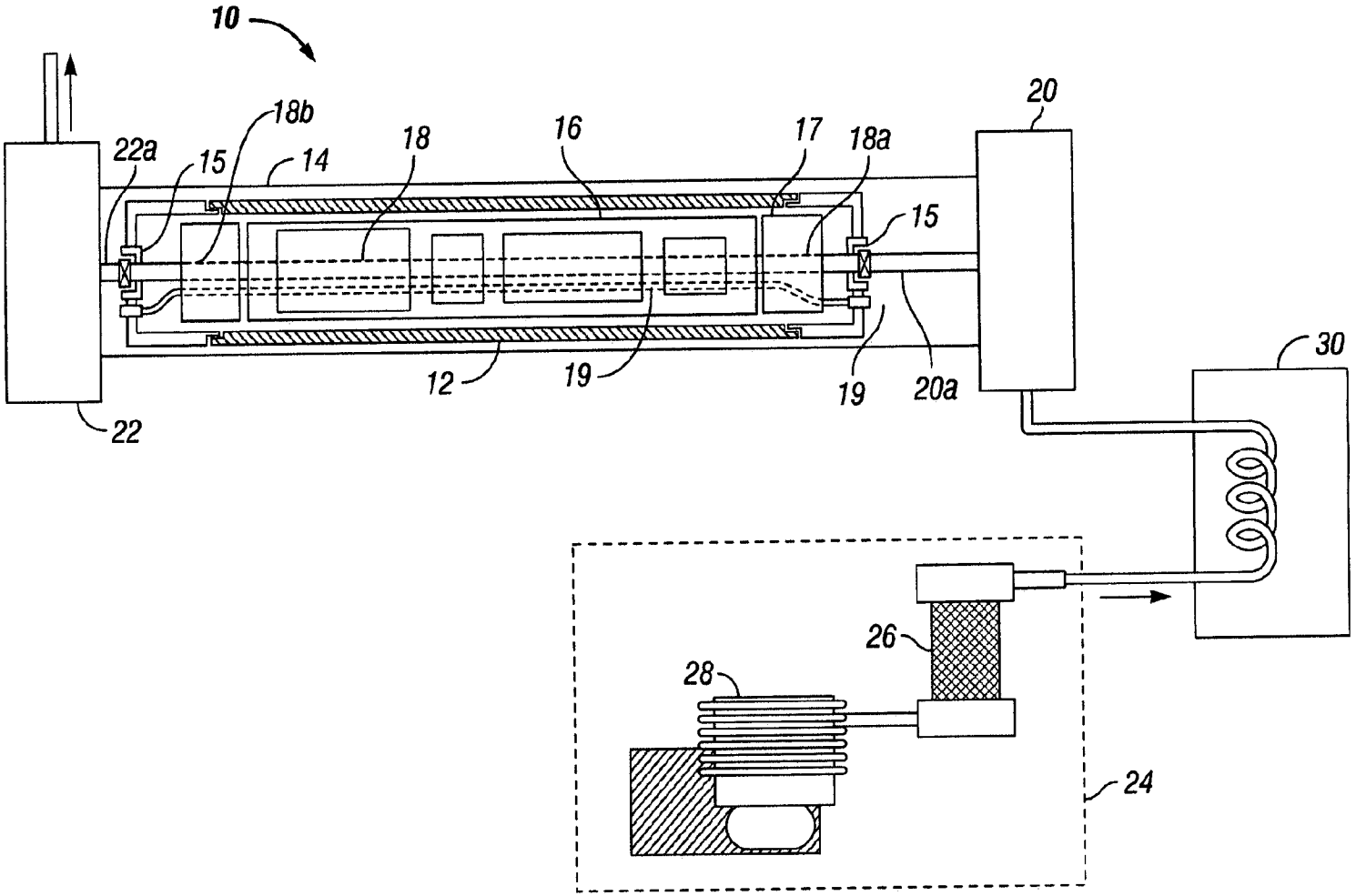
FIG. 3 is a simplified schematic of another embodiment of the apparatus in accordance with the present invention.

Referring to FIG. 3, apparatus in accordance with the present invention which functions to cool an electronics chassis of a downhole instrument to below ambient temperature comprise the components heretofore described and a heat exchanger 30 which is interposed between the source of fluid 24 and the inlet coupling 20. Heat exchanger 30 functions to reduce the temperature of the fluid in fluid source 24 to a temperature below ambient temperature before the fluid flows through passage 18. Alternatively, a vortex tube may be used to cool the fluid in the fluid source 24 to a temperatue below ambient temperature.

Figure 4:
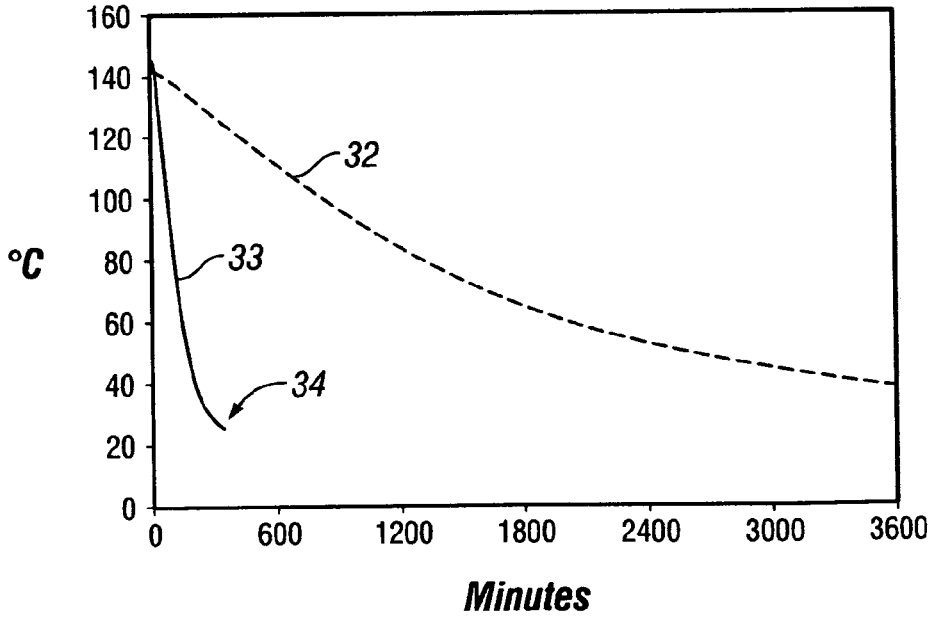
FIG. 4 is a graph which illustrates the time required for cooling an electronic chassis of a downhole logging tool using the method and apparatus of the present invention versus the time required for cooling the same tool using prior art techniques.

Referring to FIG. 4, use of the method and apparatus of the present invention has resulted in dramatically reduced cooling times for downhole instrument assemblies. For example, a test was performed by the Assignee of the present invention where a downhole instrument assembly used in logging operations was heated to about 150° C. and then allowed to cool by passive cooling. Graph 32 in FIG. 4 illustrates the amount of time that was needed to passively cool the electronics chassis in a thermal flask in the logging instrument from approximately 150° C. to slightly more than 40° C. As illustrated in FIG. 4, this passive cooling time amounted to about 3600 minutes or approximately 60 hours.

The active cooling techniques in accordance with the present invention were applied to cool the electronics package in the thermal flask in the same logging instrument referred to in the immediately preceding paragraph where the logging instrument had been heated to 150° C. Compressed air was conveyed through a passage in the thermal flask that was 0.25 inches in diameter. The amount of time required to reduce the temperature of the electronics chassis from approximately 150° C. to about 30° C. was approximately 400 minutes, or about 6.66 hours, as illustrated by graph 33 in FIG. 4. Active cooling of the electronics package in the logging instrument was terminated when the temperature of the electronics package reached approximately 30° C., as illustrated by point 34 in the graph of FIG. 4.

What is claimed is:

1. An apparatus for cooling an instrument assembly including thermally and moisture sensitive instrumentation and used in a downhole assembly deployable downhole in a well, the apparatus comprising:

a thermal flask at least partially forming a chamber containing the thermally and moisture sensitive instrumentation;

at least one passage in the chamber in which a cooling fluid may flow near the instrumentation to cool the instrumentation, the at least one passage comprising an inlet and an outlet;

at least one inlet coupling operatively and releasably connectable to the inlet of at least one passage to permit fluid to flow into the passage;

at least one outlet coupling operatively releasably connectable to the outlet of at least one passage to permit fluid flowing in the passage to exit the thermal barrier; and the at least one inlet and outlet couplings being disconnectable from when the instrument assembly is deployed downhole and connectable when the instrument assembly is retrieved from downhole.

2. The passage of claim 1, wherein each passage is hermetically sealed from the chamber.

3. The apparatus of claim 1, wherein the thermally and moisture sensitive instrumentation is mounted on a chassis.

4. The apparatus of claim 1, wherein the thermally and moisture sensitive instrumentation comprises electronic components.

5. The apparatus of claim 1, wherein the thermally and moisture sensitive instrumentation comprises optical devices.

6. The apparatus of claim 1, wherein the thermally and moisture sensitive instrumentation comprises mechanical devices.

7. The apparatus of claim 1, wherein the inlet of each passage is adapted to be operatively coupled to a fluid source.

8. The apparatus of claim 7, wherein the fluid in the fluid source is compressed air.

9. The apparatus of claim 7, wherein the fluid in the fluid source is nitrogen.

10. The apparatus of claim 7, wherein the fluid in the fluid source is carbon dioxide.

11. The apparatus of claim 1, wherein the outlet of each passage is adapted to permit fluid in the passage to exit the thermal barrier.

12. An apparatus for use in cooling moisture components used in a downhole assembly deployable downhole in a well, the apparatus comprising:

a thermal flask at least partially forming a hermetically sealed chamber comprising first and second ends and containing the moisture sensitive components for use in measuring downhole parameters;

a passage formed in the chamber in which fluid may flow near the components to cool the components in the chamber, the passage comprising an inlet and an outlet and being hermetically sealed from the components in the chamber;

an inlet coupling operatively and releasably connectable to the inlet of the passage to permit fluid to flow into the passage;

an outlet coupling operatively and releasably connectable to the outlet of the passage to permit fluid flowing in the passage to exit the chamber; and the inlet and outlet couplings being disconnectable from the passage when the downhole assembly is deployed downhole and connectable when the downhole assembly is retrieved from downhole.

13. The apparatus of claim 12, wherein the inlet and outlet of the passage are located on the same end of the chamber.

14. The apparatus of claim 12, wherein the inlet and outlet of the passage are located on opposite ends of the chamber.

15. The apparatus of claim 12, wherein the inlet of the passage is adapted to be coupled in a fluid source.

16. The apparatus of claim 15, wherein the fluid in the fluid source is compressed air.

17. The apparatus of claim 15, wherein the fluid in the fluid source is nitrogen.

18. The apparatus of claim 15, wherein the fluid in the fluid source is carbon dioxide.

19. The apparatus of claim 12, wherein the outlet of the passage is adapted to permit fluid flowing in the passage to exit the chamber.

20. Apparatus for cooling a moisture sensitive electronics chassis of a downhole instrument assembly deployable downhole in a well, the apparatus comprising:

a thermal flask at least partially forming a chamber in which the moisture sensitive electronics chassis is hermetically sealed;

a passage through the thermal flask near the electronics chassis in which a fluid may flow to cool the electronics chassis, the passage comprising an inlet and an outlet and the passage being hermetically sealed from the electronic chassis;

a pressure housing containing the thermal flask;

a fluid source;

an inlet coupling operatively and releasably connectable to the inlet of the passage and to the fluid source to permit fluid to flow from the fluid source into the passage;

an outlet coupling operatively and releasably connectable to the outlet of the passage to permit fluid flowing in the passage to exit the thermal flask; and the inlet and outlet couplings being disconnectable from the passage when the downhole instrument assembly is deployed downhole and connectable when the downhole instrument assembly is retrieved from downhole.

21. The apparatus of claim 20, wherein the fluid in the fluid source is carbon dioxide.

22. The apparatus of claim 20, wherein the fluid in the fluid source is nitrogen.

23. The apparatus of claim 20, wherein the fluid in the fluid source is compressed air.

24. The apparatus of claim 20, further comprising a heat exchanger which is interposed between the fluid source and the inlet of the passage.

25. The apparatus of claim 24, wherein the fluid in the fluid source is carbon dioxide.

26. The apparatus of claim 24, wherein the fluid in the fluid source is compressed air.

27. The apparatus of claim 24, wherein the fluid in the fluid source is nitrogen.

28. A method of cooling thermally and moisture sensitive instrumentation in a chamber formed at least partially by a thermal flask of a downhole instrument assembly deployable downhole in a well, comprising:

forming a passage in the chamber near then moisture sensitive instrumentation, the passage comprising an inlet and an outlet;

operatively and releasably connecting an inlet coupling to the inlet of the passage to permit fluid to flow into the passage;

operatively and releasably connecting an outlet coupling to the outlet of the passage to permit fluid flowing in the passage to exit the chamber;

conveying a fluid through the passage to cool the thermally sensitive instrumentation in the chamber; and disconnecting the inlet and outlet couplings from the passage when the instrument assembly is deployed downhole.

29. The method of claim 28 further comprising hermetically sealing the passage from the chamber.

30. The method of claim 28, wherein conveying fluid through the passage comprises connecting the inlet of the passage to a fluid source.

31. The method of claim 28, further comprising cooling the fluid from the cooling source before it is conveyed through the passage.

32. A method of cooling moisture sensitive electronics chassis in a thermal flask in a downhole instrument assembly deployable downhole in a well, comprising:

forming a passage in the thermal flask near the moisture sensitive electronics chassis, the passage comprising an inlet and an outlet and the passage being hermetically sealed from the electronics chassis;

operatively and releasably connecting an inlet coupling to the inlet of the passage to permit fluid to flow into the passage;

operatively and releasably connecting an outlet coupling to the outlet of the passage to permit fluid flowing in the passage to exit the thermal flask;

conveying a fluid through the passage to cool the electronic chassis; and disconnecting the inlet and outlet couplings from the passage when the instrument assembly is deployed downhole.

33. The method of claim 32, further comprising cooling the fluid from the fluid source before it is conveyed through the passage in the moisture sensitive electronic chassis.

34. A method of enhancing the transfer of heat out of a moisture sensitive electronic chassis in a thermal flask in a downhole instrument assembly deployable downhole in a well, comprising:

forming a passage in the thermal flask near the moisture sensitive electronic chassis, the passage comprising an inlet and an outlet and the passage being hermetically sealed from the moisture sensitive electronic chassis;

operatively and releasably connecting an inlet coupling to the inlet of the passage to permit fluid to flow into the passage;

operatively and releasably connecting an outlet coupling to the outlet of the passage to permit fluid flowing in the passage to exit the thermal flask;

operatively and releasably connecting a source of fluid to the inlet of the passage;

conveying fluid from the fluid source through the passage in the thermal flask to transfer heat from the electronic chassis; and disconnecting the inlet and outlet couplings from the passage when the instrument assembly is deployed downhole.

35. The method of clam 34 further comprising cooling the fluid from the fluid source to a temperature below ambient temperature before it is conveyed through the passage.

* * * * *